US010738732B2

(12) United States Patent
Schmid

(10) Patent No.: US 10,738,732 B2
(45) Date of Patent: Aug. 11, 2020

(54) CYLINDER HEAD COVER MODULE AND METHOD FOR THE PRODUCTION THEREOF

(71) Applicants: THYSSENKRUPP PRESTA TECCENTER AG, Eschen (LI); THYSSENKRUPP AG, Essen (DE)

(72) Inventor: Heiko Schmid, Mauren (LI)

(73) Assignees: THYSSENKRUPP PRESTA TECCENTER AG, Eschen (LI); THYSSENKRUPP AG, Essen (DE)

( * ) Notice: Subject to any disclaimer, the term of this patent is extended or adjusted under 35 U.S.C. 154(b) by 0 days.

(21) Appl. No.: 16/322,579

(22) PCT Filed: Aug. 3, 2017

(86) PCT No.: PCT/EP2017/069616

§ 371 (c)(1),
(2) Date: Feb. 1, 2019

(87) PCT Pub. No.: WO2018/024812

PCT Pub. Date: Feb. 8, 2018

(65) Prior Publication Data

US 2019/0203659 A1 Jul. 4, 2019

(30) Foreign Application Priority Data

Aug. 5, 2016 (DE) ..... 10 2016 114 602

(51) Int. Cl.
*F02F 7/00* (2006.01)
*F01L 1/053* (2006.01)
(Continued)

(52) U.S. Cl.
CPC ..... *F02F 7/006* (2013.01); *F01L 1/053* (2013.01); *F01M 11/02* (2013.01); *F01L 2001/0476* (2013.01)

(58) Field of Classification Search
CPC ... F02F 7/006; F01L 1/053; F01L 2001/0476; F01M 11/02
See application file for complete search history.

(56) References Cited

U.S. PATENT DOCUMENTS 5,937,812 A 8/1999 Reedy
2009/0013958 A1* 1/2009 Kumagai ..... F01L 1/053 123/195 H
2015/0308299 A1* 10/2015 Dautel ..... F01L 1/053 123/195 C

FOREIGN PATENT DOCUMENTS

DE 10 2009 051 636 A 5/2011
DE 10 2010 045 047 A 3/2012
(Continued)

OTHER PUBLICATIONS

English Translation of International Search Report issued in PCT/EP2017/069616, dated Oct. 26, 2017.
(Continued)

*Primary Examiner* — Jacob M Amick
(74) *Attorney, Agent, or Firm* — thyssenkrupp North America, LLC

(57) ABSTRACT

A method may be employed to produce a cylinder head cover module that is positionable on a cylinder head of an internal combustion engine. The cylinder head cover module may include a cover body and a camshaft arranged in the cover body. The cover body may include an opening, and a bearing element may be press-fit into the opening. The camshaft may be rotatably mounted in the bearing element, and the bearing element may seal off the opening of the cover body from the exterior. The method may involve cooling a support shaft and heating components and the cover body before introducing the support shaft into the
(Continued)

cover body, where the support shaft is led through passage opening in the components that have been heated.

3 Claims, 4 Drawing Sheets

(51) Int. Cl.
*F01M 11/02* (2006.01)
*F01L 1/047* (2006.01)

(56) References Cited

FOREIGN PATENT DOCUMENTS

| | | | |
|---|---|---|---|
| DE | 10 2012 007 334 | A | 10/2013 |
| DE | 102014106561 | A | 11/2015 |
| GB | 281104 | A | 12/1927 |
| GB | 2491268 | A | 11/2012 |
| WO | 2016016705 | A | 2/2016 |
| WO | 2016/116593 | A | 7/2016 |

OTHER PUBLICATIONS

SKF Nadellager [In process of locating English translation].
SKF Group, "Needle roller bearings", pp. 14, 19, 75, 76-78, (Apr. 2015).

* cited by examiner

CYLINDER HEAD COVER MODULE AND METHOD FOR THE PRODUCTION THEREOF

CROSS REFERENCE TO RELATED APPLICATIONS

This application is a U.S. National Stage Entry of International Patent Application Serial Number PCT/EP2017/069616, filed Aug. 3, 2017, which claims priority to German Patent Application No. DE 10 2016 114 602.1, filed Aug. 5, 2016, the entire contents of both of which are incorporated herein by reference.

FIELD

The present disclosure generally relates to cylinder heads of internal combustion engines, including cylinder head cover modules that can be positioned on cylinder heads of internal combustion engines and methods for producing such cylinder head cover modules.

BACKGROUND

In order to reduce the assembly cost during the assembly of an internal combustion engine of a motor vehicle and reduce the warehousing and logistics costs during the engine assembly process, the suppliers deliver already fully assembled engine modules directly to the assembly line of the automobile makers. Such engine modules consist, e.g., of a cylinder head cover module with one or more camshafts mounted therein. Then only this cylinder head module is fastened to the cylinder head of the engine during the engine assembly process.

From DE 10 2010 045 047 A1 for example there is known a method for assembly of a module for a motor vehicle engine with at least one cylinder head cover module and a camshaft mounted therein.

Camshafts in cylinder head cover modules are usually subjected to relatively high stresses, especially bending stresses, and forces during operation of the internal combustion engine. Thus a need exists to improve cylinder head cover modules so that the camshaft can withstand such high stresses, bending stresses, and forces.

The cylinder head cover module has a cover body and a camshaft arranged therein. The cover body has an opening, in which a bearing element is press-fitted. The camshaft is rotatably mounted in the bearing element, preferably at one of its ends. The bearing element seals off the opening of the cover body from the exterior. In particular, the opening is sealed off in an oil-tight and/or water-tight manner by the bearing element. Of course, the cover body may also have several of such openings, in each of which a bearing element of this kind is press-fitted.

In this context, the term "cylinder head cover module" should be understood to mean an assembled component, which can be arranged on a cylinder head of an internal combustion engine. By the term "cover body" is meant a base body of the cylinder head cover module, in which further elements such as the camshaft are introduced and secured during the manufacturing process of the cylinder head cover module. The cover body may be cast or injection molded, for example from plastic.

The cylinder head cover module may comprise expedient elements, such as further bearings, in which the camshaft is rotatably mounted. The camshaft expediently comprises a pipe or a support shaft, on which multiple cams are arranged.

Besides the cams, further components may also be arranged on the support shaft, such as a camshaft encoder wheel for adjusting an angle of rotation of the camshaft and/or a pump cam for driving a fuel and/or injection pump.

Of course, the cylinder head cover module may also have several camshafts. A bearing element may be press-fitted into a corresponding opening in the sense of the invention for several or all of these camshafts.

In the course of the method for producing such a cylinder head cover module, the camshaft is introduced into the cover body and in particular oriented and secured in the cover body. The bearing element is press-fitted into the opening of the cover body such that the camshaft is rotatably mounted in the bearing element, especially on one of its ends, and the bearing element seals off the opening of the cover body from the exterior. The opening of the cover body serves in particular for guiding or precisely orienting the camshaft during the manufacturing process of the cylinder head cover module, for example by means of a so-called centering or guiding lance, as further explained below.

In traditional cylinder head cover modules, the opening is closed after the camshaft has been oriented and secured, for example by means of a closing cover, which is merely inserted into the opening. The corresponding end of the camshaft is therefore not mounted, but rather freely suspended in the air. In such traditional cylinder head cover modules it is a disadvantage that the camshaft cannot withstand any comparatively large stresses or bending stresses at this end. If the camshaft in such traditional cylinder head cover modules needs to be subjected to relatively large forces or stresses, a further bearing is screwed into the cover module or the last bearing is greatly lengthened, which may result in a lengthening of the overall cylinder head cover module and an increased weight, as well as increased design space. Also, it usually cannot be ensured by the inserting of a closing cover that the cylinder head cover module is tightly closed or sealed off from the exterior.

By contrast, in a cylinder head cover module according to the invention, the inexpensive press fitting of the bearing element in the manufacturing process accomplishes better qualities and advantages. An improved mounting of the camshaft can be assured, so that the camshaft can withstand more force and be subjected to greater stresses. At the same time, the cylinder head cover module is sealed off from the exterior. Thanks to this press fit between bearing element and cylinder head cover module and the corresponding force locking connection, these two elements are tightly sealed off against each other, so that no fluids, especially no oil and/or water, and no foreign bodies can get into the cylinder head cover module. Furthermore, this force locking connection is not easy to loosen.

Advantageously, the bearing element comprises a plain bearing for rotatable mounting of the camshaft. The interior of the bearing element is expediently bored out and adjusted to the dimensions of the plain bearing. Such a plain bearing is especially suited to the mounting of the camshaft, since the sliding friction and the corresponding sliding resistance can be kept low and the heat generated can be effectively dissipated. In particular, the camshaft can be especially effectively mounted by the use of a lubricating fluid, such as an appropriate oil. Emergence of the lubricating fluid is prevented by the oil-tight and force locking connection to the cylinder head cover module.

Preferably the bearing element comprises a port for supplying the plain bearing with a lubricating fluid. For this purpose, the bearing element is oriented in particular or press-fitted with corresponding orientation in the course of the manufacturing process.

Preferably the bearing element has a closure surface, which fits together with the cover body. If the bearing element is pressed into the cover body, the opening is in particular closed by said closure surface, so that the cover body has an enclosed shell surface. According to an especially preferred embodiment, the bearing element is designed as a plain bearing block, an opening of the plain bearing being situated on one side of this plain bearing block, into which opening the end of the camshaft is introduced. On the side opposite this opening, the plain bearing block has the closure surface in particular, which fits together with the cover body and seals it off. In particular, the plain bearing and the closed surface are situated with a certain spacing from each other in the plain bearing block.

The bearing element is preferably made at least partly of aluminum. In this way, the bearing element can have a light, compact, stable and economical construction. The use of another expedient material, such as plastic, is likewise conceivable.

According to one advantageous embodiment, the camshaft comprises a pump cam at one end or in the vicinity of the end. This pump cam serves in particular for actuating a fuel and/or injection pump. Such a fuel pump is provided in particular for delivering fuel from a fuel tank to injection valves or the injection pump of the internal combustion engine. By means of such an injection pump, fuel is delivered expediently under high pressure through the injection valves into the combustion chamber of the cylinder or the intake pipe. By arranging such a pump cam at the end of the camshaft a relatively large bending stress is produced, which can be effectively compensated by the bearing element. Of course, other expedient components may also be arranged at the end of the camshaft, such as a camshaft encoder wheel.

Advantageously the camshaft is inserted into the cover body by introducing a support shaft and components connected to the support shaft, especially cams as well as pump cams and/or a camshaft encoder wheel, into the cover body and connecting them with each other in the cover body. The camshaft thus has a modular design and the individual modular elements of the camshaft are assembled only in the course of the manufacturing process of the cylinder head cover module. The cylinder head cover module can thus be manufactured in an especially simple and flexible manner.

Advantageously the support shaft of the camshaft is introduced through the opening or through a second opposite opening into the cover body during the manufacturing process. A further bearing can be arranged in this second opening, such as a plain bearing, through which the support shaft is introduced into the cover body. As already explained, the support shaft or the assembled camshaft can be led through the opening and/or also through the second opening, for example by means of a centering or guiding lance. In this way, the camshaft can be led precisely through the opening or openings during the manufacturing process and the opening can be closed tightly by means of the bearing element after the securing of the camshaft.

According to one preferred embodiment, the cylinder head cover module is produced by means of the so-called Presta[2] method developed by the applicant. A detailed description of such a method is disclosed for example in DE 10 2010 045 047 A1.

Preferably the components connecting to the support shaft are at first arranged in the cover body. The components expediently have passage openings, through which the support shaft can be led. In particular, the components are arranged in the cover body such that their passage openings are aligned with the opening in the cover body. For this purpose, a guiding or centering lance can be used, in particular.

Advantageously the support shaft is cooled, for example by means of liquid nitrogen. The cover body and the components connected to the support shaft are at first heated. For example, the support shaft may be cooled down to temperatures of as low as −200° C., the components may be heated up to temperatures of as much as +200° C. and the cover body in particular to temperatures between 45° C. and 65° C. The support shaft thus contracts and its diameter becomes smaller. The components and the cover body expand in this process.

The cooled support shaft is preferably introduced into the heated cover body and led preferably through the passage openings in the heated components. In particular, the support shaft is introduced through the opening in the cover body or through the second opening. For example, the support shaft may be designed hollow on the inside and it may be pushed across the centering lance. The cooled and contracted support shaft can be led especially easily into the expanded cover body and through the expanded components.

The support shaft is thereupon preferably heated and the components and the cover body are preferably cooled. This heating and cooling may occur actively, but an automatic temperature equalization may also occur, waiting until the support shaft, cover body and components have reached room temperature. The support shaft may then be oriented precisely in the cover body, especially through the opening by means of centering lances, and likewise the components can be oriented relative to the support shaft. After this, the components can be firmly connected to the support shaft, for example, by press fitting the components onto the support shaft.

Preferably the bearing element is thereupon press fitted into the opening such that the camshaft is rotatably mounted in the bearing element and the bearing element seals off the opening of the cover body from the exterior. The bearing element may also be press-fitted into the opening at an earlier time in the manufacturing process. For example, the bearing element may also be press-fitted into the opening at the start of the manufacturing process. After this, the components are arranged in the cover body, and the cover body and components are heated. The support shaft is cooled, introduced through the second opening into the cover body, and led through the passage openings and into the bearing element. After this, the cover body and components are cooled, and the support shaft is heated.

Further benefits and embodiments of the invention will emerge from the description and the accompanying drawing.

Of course, the features mentioned above and yet to be further explained below may be used not only in the particular indicated combination, but also in other combinations or standing alone, without leaving the scope of the present invention.

The invention is represented schematically with the aid of an exemplary embodiment in the drawing, and it shall be described below with reference to the drawing.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to cylinder head cover modules that are positionable on cylinder heads of internal combustion engines. The present disclosure also generally relates to methods for producing such cylinder head cover modules, which in some examples include a cover body and a camshaft arranged therein. The cover body may include an opening.

In FIGS. 1 to 4 (*b*) the same reference numbers each time denote the same or similar elements and are not explained separately.

Figure 1:
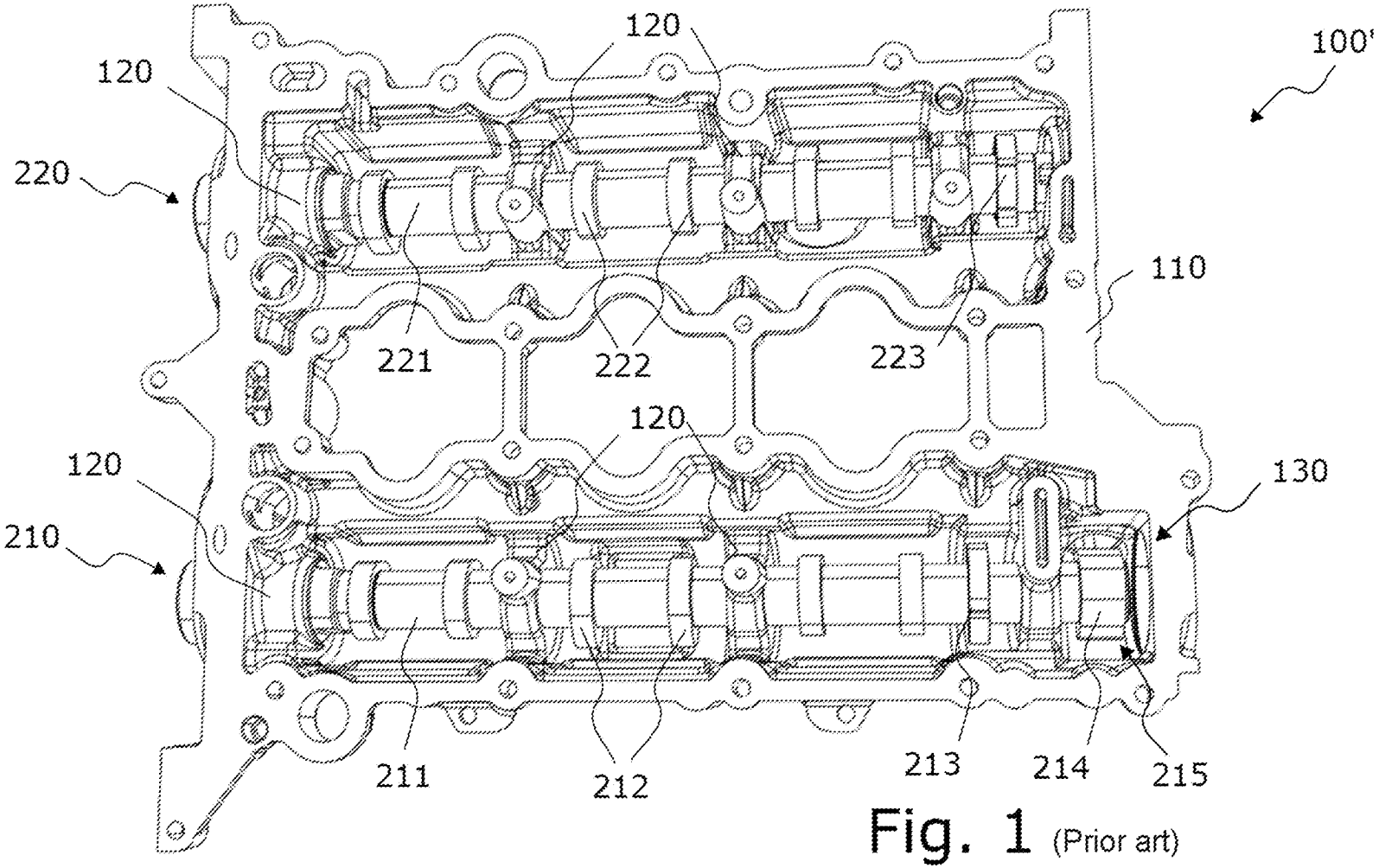
Fig. 1 (Prior art)
FIG. 1 is a schematic, perspective, sectional view of a prior art cylinder head cover module.

FIG. 1 shows schematically a traditional cylinder head cover module of the prior art in a perspective sectional view, denoted as 100'. The cylinder head cover module 100' is designed to be arranged on a cylinder head of an internal combustion engine, such as that of a motor vehicle.

The cylinder head cover module 100' comprises a cover body 110, in which are arranged a first camshaft 210 and a second camshaft 220. The camshafts 210 and 220 are rotatably mounted in bearings, for example, designed as a plain bearing 120, which are arranged in the cover body 110. The camshafts 210 and 220 each comprise a support shaft 211 and 221, respectively, to which a plurality of components are connected, namely, cams 212 and 222 as well as a camshaft encoder wheel 213 and 223. At one end 215 of the first camshaft 210 there is arranged a pump cam 214, which can drive an injection pump.

The cover body 110 has an opening 130 in an area near the end 215 of the first camshaft 210. By this opening 130, the first camshaft 210 can be guided relative to the cover body 110 in the course of a manufacturing process for the cylinder head cover module 100'.

In such a traditional cylinder head cover module 100', a closing cover is inserted into this opening 130. However, such a closing cover might not be able to ensure that the cylinder head cover module 100' is closed tightly and completely sealed off.

Figure 2:
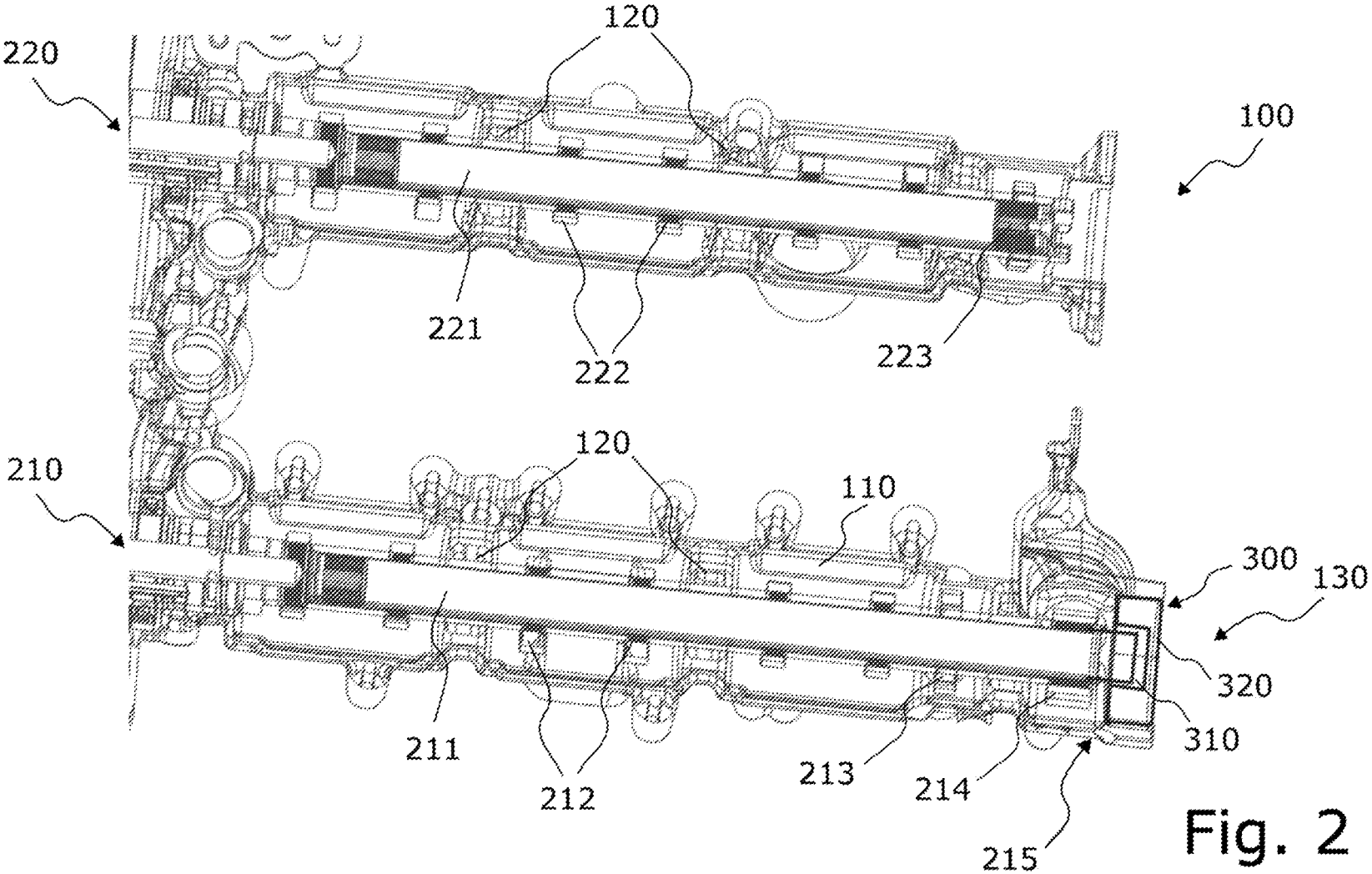
FIG. 2 is a schematic, perspective, sectional view of an example cylinder head cover module.

By contrast to this, FIG. 2 shows one preferred embodiment of a cylinder head cover module 100 according to the invention in a perspective sectional view. The cover body 110 of the cylinder head cover module 100 is represented only partly schematically, for reasons of clarity.

As can be seen in FIG. 2, a bearing element 300 is arranged on the end 215 of the first camshaft 210. This bearing element 300 is press fitted into the opening 130 of the cover body 110.

The bearing element 300 is designed preferably as a plain bearing block of aluminum. In its interior, the bearing element 300 comprises a plain bearing 310. The interior of the plain bearing block is bored out for this purpose and adjusted to the dimensions of this plain bearing 310. The first camshaft 210 is rotatably mounted on the end 215 in the bearing element 300 or in the plain bearing 310 of the bearing element 300.

Furthermore, the bearing element 300 or the corresponding plain bearing block has a closure surface 320. When the bearing element 300 is press fitted into the opening 130 of the cover body 110, the opening 130 is closed by this closure surface 320 and the cover body 110 has an enclosed shell surface, in particular. The bearing element 300 or the closure surface 320 thus seal off the opening 130 of the cover body 110.

Of course, a corresponding opening may be provided for the second camshaft 220 in the cover body and a bearing element may also be press fitted into this opening, similar to the above description.

Figure 3:
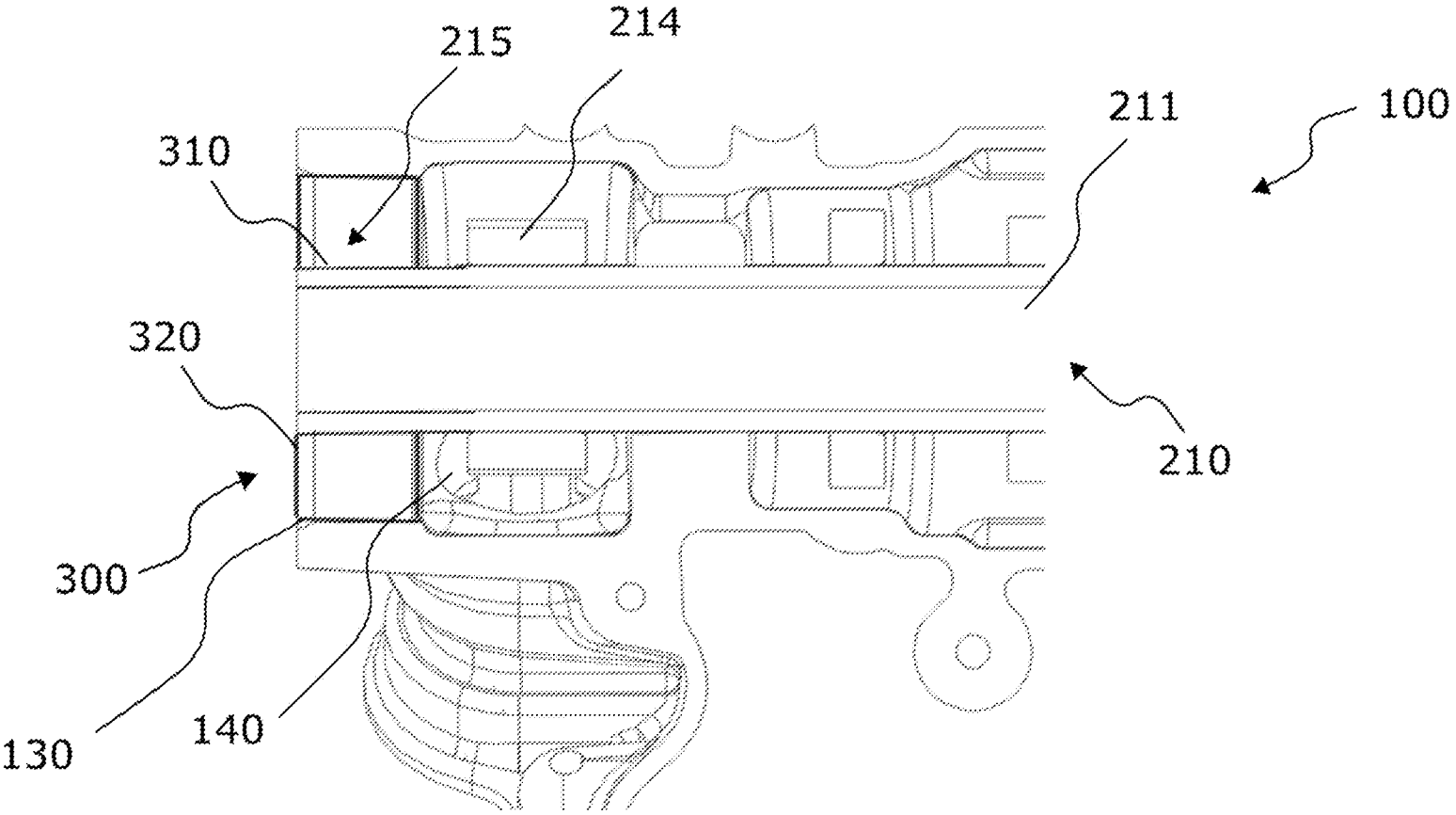
FIG. 3 is a schematic, perspective, sectional view of a portion of an example cylinder head cover module.

FIG. 3 shows schematically a portion of the cylinder head cover module 100 of FIG. 2 in a perspective sectional view. In FIG. 3, the first camshaft 210 is shown with the support shaft 211 and the pump cam 214 arranged at the end 215. A connection 140 can be seen, by which the pump cam 214 can be connected to an injection pump. Furthermore, FIG. 3 shows the bearing element 300 with plain bearing 310 and closure surface 320, which is press fitted into the opening 130.

Figure 4A:
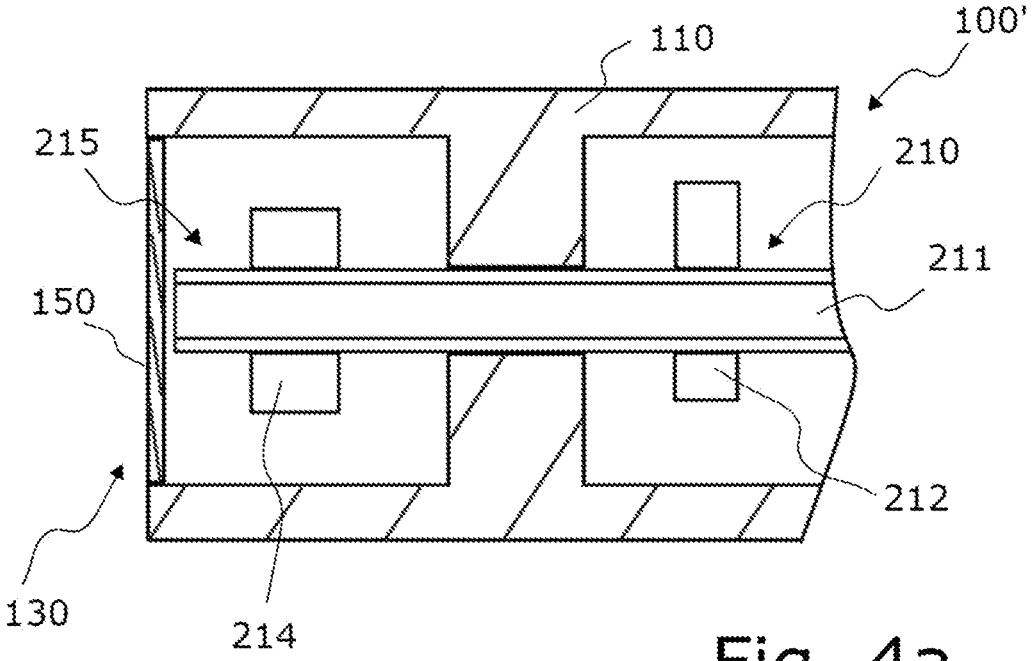
Fig. 4a (Prior art)
FIG. 4*a* is a schematic, cross-sectional view of a portion of a prior art cylinder head cover module.

FIG. 4*a* shows schematically a portion of the traditional cylinder head cover module 100' of the prior art from FIG. 1 in a cross sectional view. As can be seen, a closing cover 150 has been inserted into the opening 130 of the cover body 110 of the traditional cylinder head cover module 100'. The end 215 of the first camshaft 210 in this traditional case is not mounted, but rather suspended freely in the air. The first camshaft 210 usually cannot withstand any comparatively large stress or forces here. In particular, however, comparatively large bending stresses may result from the pump cam 214.

Figure 4B:
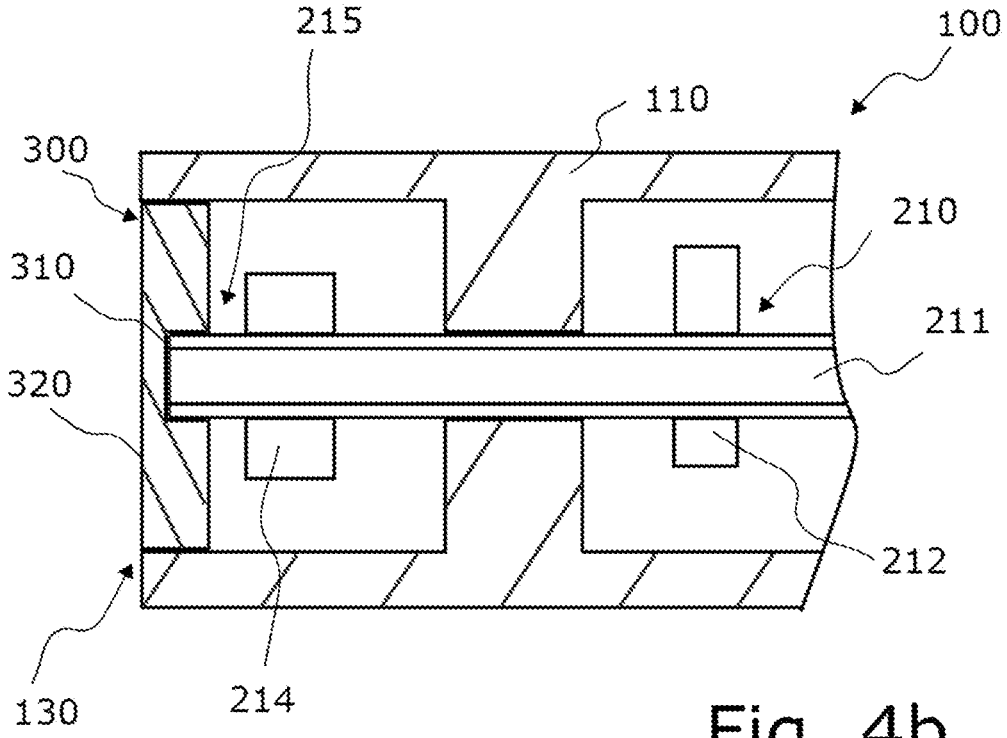
FIG. 4*b* is a schematic, cross-sectional view of a portion of an example cylinder head cover module.

FIG. 4*b* shows schematically, for comparison, a portion of the preferable embodiment of the cylinder head cover module 100 according to the invention from FIG. 2 in a cross sectional view. As can be observed, the end 215 is rotatably mounted in the plain bearing 310 of the bearing element 300. Thus, the first camshaft 210 can withstand greater stresses, especially greater bending stresses due to the pump cam 214, as compared to the case in FIG. 4*a*.

LIST OF REFERENCE NUMBERS

100' Cylinder head cover module of the prior art
100 Cylinder head cover module according to one preferred embodiment of the invention
110 Cover body
120 Bearing, plain bearing
130 Opening of the cover body
140 Connection to an injection pump
150 Closing cover
210 First camshaft
211 Support shaft
212 Cam
213 Camshaft encoder wheel

214 Pump cam
215 End of first camshaft
220 Second camshaft
221 Support shaft
222 Cam
223 Camshaft encoder wheel
300 Bearing element
310 Plain bearing
320 Closure surface

What is claimed is:

1. A method for producing a cylinder head cover module, the method comprising:

inserting a camshaft into a cover body, wherein inserting the camshaft into the cover body comprises introducing a support shaft and components connected to the support shaft into the cover body and connecting the support shaft and the components with each other in the cover body to form the camshaft; and press fitting a bearing element into an opening of the cover body such that the camshaft is rotatably mounted in the bearing element and such that the bearing element seals off the opening of the cover body.

2. The method of claim 1 wherein the opening of the cover body is a first opening, wherein the support shaft of the camshaft is introduced through the first opening or through a second opening into the cover body, wherein the second opening is opposite the first opening.

3. The method of claim 1 comprising:

cooling the support shaft;

heating the components and the cover body, wherein the support shaft that has been cooled is introduced into the cover body that has been heated, wherein the support shaft is led through passage openings in the components that have been heated;

heating the support shaft; and cooling the components and the cover body.

* * * * *